United States Patent [19]

Aiken

[11] Patent Number: 4,786,534

[45] Date of Patent: Nov. 22, 1988

[54] DISPOSABLE PACKAGE FOR LIQUID MATERIAL AND METHOD OF MAKING SAME

[75] Inventor: Radcliffe W. Aiken, Marlboro, N.J.

[73] Assignee: Business Systems Enterprises, Inc., Metuchen, N.J.

[21] Appl. No.: 9,472

[22] Filed: Feb. 2, 1987

[51] Int. Cl.[4] ..... B65D 1/24; B65B 7/28

[52] U.S. Cl. ..... 428/34.2; 53/289; 53/329; 206/44.11; 206/45.11; 206/484.2; 206/486; 428/522; 428/35.7

[58] Field of Search ..... 206/44.11, 45.11, 484.2, 206/486, 823; 53/289, 329; 428/35, 522, 40

[56] References Cited

U.S. PATENT DOCUMENTS

| | | | |
|---|---|---|---|
| 2,547,779 | 4/1951 | Renyck | 206/229 |
| 2,561,400 | 7/1951 | Morrell | 206/229 |
| 2,775,246 | 12/1956 | Morrell | 206/229 |
| 3,404,774 | 10/1968 | Levine | 206/471 |
| 3,759,375 | 9/1973 | Nappi | 206/209 |
| 3,835,834 | 9/1974 | Brown et al. | 206/229 |
| 3,862,684 | 1/1975 | Schmit | 206/498 |
| 3,910,410 | 10/1975 | Shaw | 206/486 |
| 4,236,652 | 12/1980 | Beguhn | 206/484 |
| 4,324,331 | 4/1982 | Ignasiak | 206/363 |
| 4,474,016 | 10/1984 | Winchell | 206/484 |
| 4,537,305 | 8/1985 | Takanashi | 206/484 |
| 4,582,756 | 4/1986 | Niinuma et al. | 428/327 |

*Primary Examiner*—John E. Kittle
*Assistant Examiner*—James J. Seidleck
*Attorney, Agent, or Firm*—Gerald W. Griffin; Christopher C. Dunham

[57] ABSTRACT

A disposable blister-type package for containing a small quantity of liquid material such as nail enamel including a volatile solvent, constituted of a thermoformed tray defining a liquid-holding cavity with a surrounding rim and a lid covering the cavity and secured to the rim, wherein at least the facing surface portions of the tray and lid are formed of acrylonitrile methylacrylate copolymer. The facing methylacrylate surfaces of the lid and tray are directly bonded together around the cavity to form a leakproof seal that is readily peelable. The seal region of the lid surface is embossed, during the sealing operation, with a pattern of serrations to facilitate peeling. A disposable applicator for the liquid may be enclosed, and similarly sealed, within a second tray cavity also covered by the lid and isolated by the seal from the liquid-holding cavity.

11 Claims, 1 Drawing Sheet

DISPOSABLE PACKAGE FOR LIQUID MATERIAL AND METHOD OF MAKING SAME

BACKGROUND OF THE INVENTION

This invention relates to disposable packages for holding small, typically single-use quantities of a liquid material containing a volatile solvent, and to methods of making such packages.

By way of specific illustration, the invention will be particularly described with reference to the packaging of a unit-of-use quantity of nail enamel, together with an applicator. Such packaging constitutes one important field of use of the invention, which, however, in its broader aspects is not limited thereto.

It would be desirable to provide nail enamel in disposable unit-of-use packages (also conveniently containing a disposable applicator) for sale or promotional distribution, e.g. as samples to enable a customer to try out an enamel without having to invest in the purchase of a large quantity. Necessary or advantageous attributes of a package of this type include low cost, infrangibility, good sealing of the contained enamel, extended shelf life, ease of opening for use, attractive appearance, and ability to bear externally visible imprints of an informative and/or decorative nature.

Commercial nail enamel formulations include volatile solvents such as toluene, isopropyl alcohol, ethyl acetate, and butylacetate, together with other chemical compounds. Owing particularly to the volatile solvent content, these formulations attack plastics commonly used for disposable packaging. Thus, while conventional plastic blister packages as currently employed for a wide variety of consumer products offer advantages with respect to cost, secure sealing, resistance to breakage, and ability to be imprinted with designs and information, their use to package nail enamel has heretofore been precluded. An additional problem with blister packages is that rupture of the seal is often difficult; if a blister package contains a liquid, difficulty in opening the package is likely to cause spillage.

Accordingly, nail enamel in consumer quantities is usually packaged in glass. Sample amounts of nail enamel must at present be provided in glass vials which contain much more product than is required for single-use sampling, yet are so small as to require an attached paperboard carrier to bear printed information and descriptions of use; the high cost of such sample packaging has been prohibitive for many manufacturers.

Similar considerations are applicable to the packaging, and especially unit-of-use or sample packaging, of other liquid products that contain volatile solvents, e.g. other cosmetic materials, paints, etc.

SUMMARY OF THE INVENTION

The present invention in a first aspect broadly contemplates the provision of a package, for containing a body of liquid material including a volatile solvent, comprising a molded sheet plastic tray defining at least one cavity, for receiving the body of liquid material, and having a substantially planar rim completely surrounding the cavity; and a lid of sheet material extending entirely over the cavity and secured to the rim to enclose the body of liquid material. In accordance with the invention, and as particular features thereof, at least the facing surface portions of the tray and lid, including the tray surface portion facing the cavity interior, are constituted of a polymeric material resistant to attack by the liquid material: and the lid and tray are secured together as aforesaid by direct bonding of the polymeric material of the lid portion to that of the facing tray portion around the rim to provide a bond that seals the liquid material within the cavity but ruptures substantially uniformly under manual peeling forces to enable removal of the lid from the tray.

It is currently preferred to bond the polymeric material of the lid to that of the tray with heat and pressure. However, the bond may also be produced by ultrasonic or radio frequency sealing, for example.

As a further specific feature of the invention, the aforementioned polymeric material is acrylonitrile methylacrylate copolymer, which, in the described use, exhibits high resistance to attack by nail enamel as well as many other liquid products. Acrylonitrile methylacrylate is capable of bonding to itself to form a bond having the characteristics of sealing and peelability just described. The tray may, for example, be formed from sheet acrylonitrile methylacrylate, or it may be a laminate of acrylonitrile methylacrylate and other, less resistant plastic (e.g. polyvinyl chloride) with the methylacryllate serving as a barrier layer lining the interior of the cavity and facing the lid. The lid is a laminate of a substrate sheet (preferably itself a laminate of paper, foil, and polyester) and a thin barrier film of acrlylonitrile methylacrylate on the side facing the tray. The lid can thus easily be imprinted with informative and/or decorative material, both on the side facing away from the tray and (if the tray is itself transparent) on the side facing tow ard the tray.

As a still further particular feature of the invention, the bond is formed in such manner as to emboss the surface area of the seal with small stippling or serrations. These serrations facilitate smooth manual peeling of the lid from the tray, while nevertheless providing an adequately tight seal to prevent leakage of the typically relatively viscous liquid material in the cavity.

For the packaging of nail enamel and like cosmetic products, e.g. in sample or unit-of-use quantities, the tray is advantageously provided with a second cavity (isolated from the liquid-holding cavity, as well as from the package exterior, by the seal) for holding a disposable applicator such as a brush. Isolation of the applicator from the liquid prevents premature fouling of the applicator by the liquid.

The invention in a second aspect embraces a method of making a package of the foregoing type, including the steps of molding a plastic sheet having at least a surface portion of solvent-resistant polymeric material to form a tray including at least one liquid-receiving cavity with a surrounding substantially planar rim, wherein the polymeric material surface portion lines the cavity and the rim; filling the cavity with a predetermined quantity of a volatile-solvent-containing liquid to be packaged; covering the cavity and surrounding rim with a lid of sheet material having at least a surface portion, facing the tray and engaging the rim, formed of the aforementioned polymeric material; and bonding the polymeric material of the tray rim to the polymeric material of the lid around the rim to provide a bond that seals the liquid within the cavity but is readily and substantially uniformly releasable by manual peeling forces.

Further features and advantages of the invention will be apparent from the detailed description hereinbelow set forth, together with the accompanying drawing.

DETAILED DESCRIPTION

Figure 1:
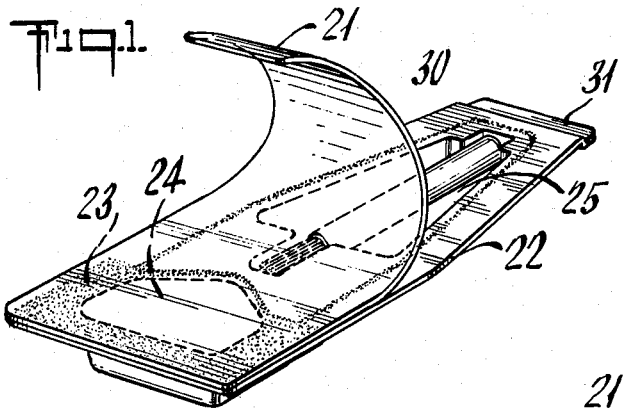
FIG. 1 is a schematic perspective view of a sample nail enamel package embodying the present invention in a particular form.

The invention will be particularly described as embodied in a disposable package of the blister type for holding a unit-of-use quantity of nail enamel (i.e. sufficient enamel for one liberal application of several coats to the fingers and/or toes of the user) together with a disposable applicator. Such a package may be employed, for example, for promotional distribution, to provide a sample that the user can try out before purchasing a larger quantity of the enamel.

In the illustrated package, successive layers of paper 10, aluminum foil 11, polyester 12, and a barrier film 13 (FIG. 2) are laminated together to constitute a laminated sheet for a package lid 21 (FIG. 1), covering a thermoformed base tray 22 and secured thereto at a bond or sealing region 23. This particular arrangement of layers represents one suitable illustrative lid laminate, but others are possible within the scope of the invention, one very satisfactory laminate (for example) comprising successive layers of paper, polyester, foil, and barrier film. The tray is formed with a first cavity 24 which serves as a reservoir for the liquid nail enamel; and a second cavity 25 which serves as a receptacle for a disposable nail enamel applicator brush 30, each cavity being (in the illustrative embodiment) approximately 3/16 inch in depth. It will be appreciated that the cavities may be of a different depth if desired, e.g. a depth of as much as ½ inch or even more. The seal 23 completely surrounds both cavities and also separates them from each other. To enable separation of the lid from the tray, an unbonded tab portion 31 is provided at one end of the package.

The purpose of this package is to provide nail enamel manufacturers, distributors, and cosmetics companies with a viable unit-of-use package for sampling or a unit-of-use trade package. In a broad sense, however, the use of such a package embodying the invention is not limited only to sampling nail enamel. There are a variety of other consumer, institutional, and industrial products for which such packages may be used.

As a trade item, the filled packages may be sold through various distribution channels directly to the consumer, or may be used as a method of sampling the products through various channels of distribution. The consumer uses the package by laying the base 22 down on a flat surface with the lid 21 upwards; the lid is held firmly at the tab 31 and peeled back away from the tray to expose the brush and the nail enamel. The lid is peeled back just enough to allow access to the brush and the enamel. The brush is then removed from its cavity and dipped into the enamel. The fingernails or toenails can then be polished with the enamel. There usually will be enough enamel in the cavity 24 to cover at least ten nails with two coats of polish.

AIthough at first glance the package of the invention appears similar to conventional packages of simple construction, it has special attributes of chemical resistance and peelability, employing particular thermoplastic films which possess the physical properties and characteristics to provide containment as well as peelability, together with extended shelf life of the product and package combination. The sealing characteristics of this film make it possible to achieve a hermetic seal 23 around the product cavity while at the same time allcwing for peelability of the lidding material.

This package has a special peelable lidding laminate 21 which may be printed on both sides giving the opportunity to obtain six colors of artwork and text on either side. The thermoformed base tray 22 is of a transparent material allowing the graphics to be visible without distortion through the plastic after the package is asembled. The color of the enamel in the reservoir and the brush applicator can be clearly seen through the base. This enhances the aesthetics of the package and makes the graphic design capabilities almost unlimited.

Alternatively, the base tray can be an opaque thermoplastic film and the lidding material a clear composite laminated structure to allow for chemical resistance and peelability. Such lidding film may be printed on one side with up to six colors of graphics and text.

In further keeping with this invention, there is another method of decorating this package. The thermoformed base tray material may be pre-printed with graphics either gravure or flexographically produced. The lidding material may be printed either on one side or on both sides. Printing on the inside is revealed when the lid is peeled back.

The configuration and contour of the cavities in the base tray, and the shape of the die-cut of the completed package can be made in a variety of combinations and designs. The potential for different shapes, depth of draw and layouts is relatively unrestricted. Provision of a single cavity in the base with the application of the materials and sealing methods described is also within the broad scope of the invention.

Referring futher to the drawing, FIG. 1 is illustrative of one method of forming a unit-of-use package of this invention, and illsutrates as well the manner in which the package would be opened to use its contents—the brush 30 and the enamel in the reservoir 24. As stated, the thermoformed base tray has two cavities, one for the product and the other for the applicator. It is opened by delaminating the lid and the tray. The unique peelable seal makes this possible. The cross-hatching indicates the area and configuration of the seal 23 around the reservoir 24 and around the brush cavity 25.

Figure 2:
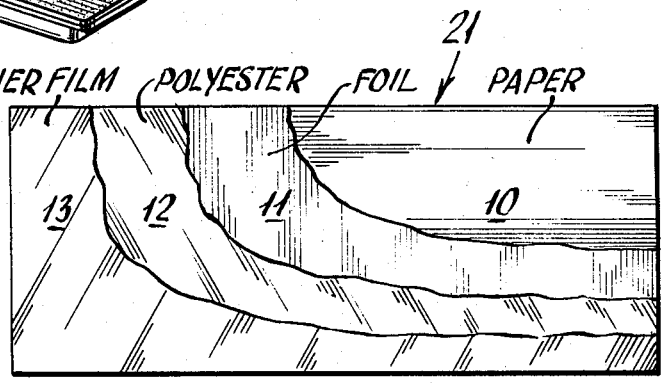
FIG. 2 is a schematic plan view, partly broken away, of the sheet material used for the lid of the package of FIG. 1.

FIG. 2 is a segment of the material for the lid 21 which is, in most cases, preprinted and supplied in roll form. This view shows the different layers of material laminated together to form a composite structure. The basic structure is formed of paper 10, aluminum foil 11, polyester 12, and chemical barrier film 13.

Figure 3:
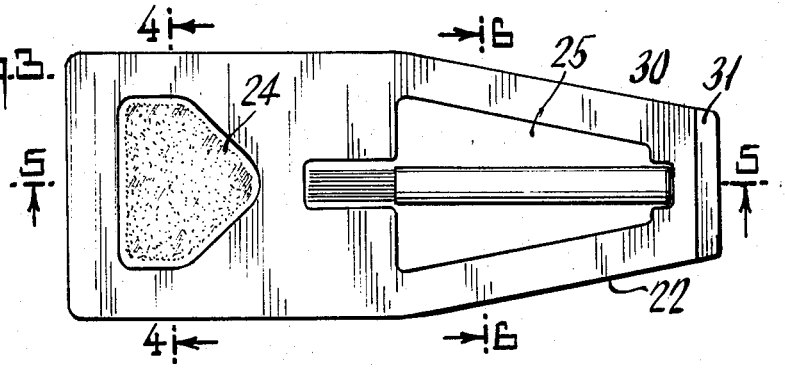
FIG. 3 is a plan view of the base tray of the package of FIG. 1.

FIG. 3 is a plan view of the base tray 22 die-cut in the shape of a bottle. The two cavities 25 and 24 are clearly seen, one for the brush 30 and the other for the product. It also shows the recessed tab 31 for gripping the lid 21 for peeling.

Figure 5:
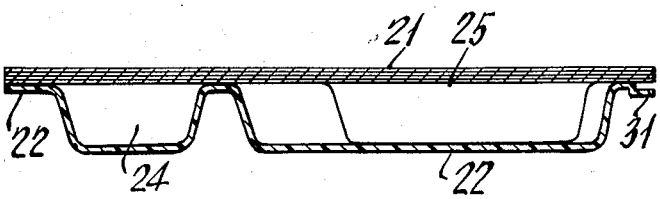
FIG. 5 is a longitudinal sectional view of the package, taken as along the line 5—5 of FIG. 3.
Figure 4:
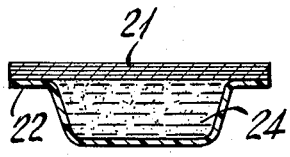
FIG. 4 is an enlarged cross-sectional view of the package, taken as along the line 4—4 of FIG. 3.

FIG. 4 shows, in enlarged section, the product cavity 24 with the lidding material 21 in place. FIG. 5 illustrates in sectional view from left to right the sealed end, the product cavity 24, a small section of the tray 22 in contact with the lidding material 21 for sealing, the cavity 25 housing the brush 30, a section of the tray 22 in contact with the lid again for sealing, and the recessed tab section 31 where the lid and the tray are separated to facilitate peeling.

Figure 6:
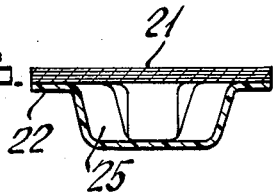
FIG. 6 is a further cross-sectional view of the package, enlarged similarly to FIG. 4 and taken as along the line 6—6 of FIG. 3.

FIG. 6 is a cross-sectional view depicting the relative position of the brush 30 in its cavity 25. The tray section molded away from the brush is made to allow ease in removing the brush from its cavity.

The basic design of this package incorporates the use of existing thermoforming technology to form, fill and seal the chemically resistant plastic tray material. However, the present invention involves an application of this continuous blister technology which is unique in manufacturing and materials of construction.

Starting with the materials of construction, it has been determined that only a selected number of plastic materials are chemically resistant to aromatic hydrocarbons. From this group, it was determined that thin-gauge films 13 extruded from acrylonitrile methylacrylate copolymer provide excellent chemical resistance to those volatile solvents such as toluene, isopropyl alcohol, ethyl acetate, and butylacetate, plus other chemical compounds which are formulated in nail enamel. Such acrylonitrile methylacrylate, commercially available under the trademark "Barex," is suitable for the lid barrier film and the tray.

The present unit-of-use package can be produced at a fraction of the cost of glass vial samples of nail enamel, and with superior production standards. Moreover, again in contrast to glass vial sample bottles of nail enamel, the present unit-of-use package does not require an additional paper board carrier (to convey appropriate information and description of use), because it has two complete surfaces for graphics. The lidding material can be printed on both sides and remains strong enough to contain the product as well as to peel away from the base to expose the contents. A discount coupon may be printed on one side as an incentive for future purchase.

The lidding material 21 is applied to the formed tray from a roll. This laminated lidding material has each layer held together with a high performance adhesive. Various combinations of the above structure may be engineered. However, to achieve a peel seal in the lidding material of the described illustrative embodiment, the lidding material is at minimum a composite of polyester 12 of at least 48 gauge, the barrier film (acrylonitrile methylacrylate) 13 of at least one mil thickness, and 35 gauge aluminum foil 11. In the package, the lid is oriented so that the barrier film 13 faces the tray 22. The strong-adhesive bonding of the barrier film to the substrate laminate (layers 10, 11 and 12) of the lid aids in achieving peelability of the lid from the tray.

The material of base tray 22 is a much heavier gauge sheet (at least ten mils, typically between about 10 and 20 mils) of the barrier film material (acrylonitrile methylacrylate). Alternatively, the tray sheet may be a laminated structure (to be more cost effective) constituted of a less resistant polymeric sheet clad with an acrylonitrile methylacrylate barrier film on the inside of the tray (to line the cavity and face the lid). This base tray material, again, is supplied in a roll for thermoforming.

In the described embodiments of the package and method of the invention, as further set forth below, the tray and lid are bonded together with heat and pressure. Other suitable bonding techniques include ultrasonic sealing and radio frequency sealing.

Conveniently, the packages of the invention are produced on a horizontal process line including successive thermoforming, filling, and sealing machines equipped with digital electronics instrumentation and programmable controllers. Temperature control thermocouples on the forming molds and the sealing dies are designed to maintain temperature setting in a close tolerance range of ±2.5%. The line has a hydraulic pressure asssembly and electronic timing devices controlled with precision to very close tolerances. These controls are not normally found on standard thermoforming equipment. In order to achieve a consistent peelable seal between the lid 21 and tray 22 the machine settings are at specific temperature, pressure and dwell time and are held at close tolerances for each combination of lidding laminate and base tray material or laminate.

Further, the sealing dies are designed to have a pattern of serrations machined on the face of the top die, for embossing a like pattern of small serrations on the region of seal 23 on the lid 21. The contour of the seal 23 around the product reservoir 24 is wide at the outer ends and very narrow at the innermost section towards the brush 30, and continues in a similar narrow fashion around the contour of the brush cavity 25 These features allow the lidding material to be peeled back with relative ease to expose a small portion of the product reservoir.

Significantly, the peel seal is not achieved by applying a peel seal adhesive to the lidding material. That is to say, the two facing surfaces (lid and tray) of the methylacrylate material are directly bonded together with heat and pressure while a pattern of bond serrations is embossed on the seal region of the lid. If typical peel seal adhesives were used, the volatile solvent present in nail enamel would react chemically with the coating and the integrity of the seal would be destroyed in a matter of minutes. Since the two mating surfaces of the package are the same chemically resistant barrier film material (acrylonitrile methylacrylate), peelability is achieved under the controls described previously.

The special advantages of the invention are attributable to this peelable seal and the film's ability to remain stable while containing volatile chemical compounds. Household and industrial chemicals, lighter fluid, cleansers, insecticides, disinfectants, deodorants, cleaning agents, cosmetics and toiletries are effectively contained by this film formed into containers. In addition, the strength of the film enables the packages to withstand rough handling; sheet and film packages display high impact resistant and shatterproof qualities for safe handling and long life. Moreover, since the barrier film is non-toxic when handled under normal conditions and conforms to the standards set for contact with food, the invention may be utilized for food products as well.

The process of manufacturing the described package is performed on a horizontal blister machine equipped with the control features detailed previously. A flat continuous sheet of the thermoformable tray material (acrylonitrile methylacrylate is drawn from a roll through the molding dies. The sheet is preheated before the vacuum holding station where the cavities are formed into the plastic.

Several rows of cavities are formed simultaneously utilizing a combination mold. Afterwards, the continuous molded plastic is drawn into the extended work areas of the machine where the brushes/applicators are manually or automatically placed in their cavities. Subsequently, the molded web with the brushes in place is pulled to the liquid filling station where the enamel is precisely metered into the product reservoirs. A controlled atmosphere is maintained over the filling area to exhaust the volatile solvent vapors. It is possible to fill several different colors at the same time, utilizing a separate pumping system for each product.

The lidding material, from a separate roll, mounted above or adjacent to the sealing area, is fed over the base tray on a continuous basis. The tray and lidding materials are drawn together through to the sealing dies, which, as stated, in the described illustrative embodiment effect the sealing by application of heat and pressure. At this point, the heat sealing is accomplished under precise control of pressure, temperature and dwell time. The combined continuous blister is then drawn into the cutting die station where the individual packages are cut from the web and the residue is wound onto a waste roll. The individual die-cut packages are conveyed to a secondary operation such as tip-ons, etc., or packaged for shipment.

The unit-of-use package construction size, shape, and graphic capability can be utilized effectively in a variety of promotional campaigns as well as containing trade products for direct consumer use. Non-limiting examples of distribution techniques include direct mail to consumers; magazine inserts, tip-on; point-of-sale displays; inclusion in statement enclosures; free standing newspaper inserts; direct sales of trade packages; vending machines; and attachment to other merchandise.

The nail enamel sample package can be used to promote a complete nail care program. Multicolors, base coat and top coat as well as nail hardener, etc., can be filled in the blister package. Each package can be die cut separately or up to six different color combinations produced at the same time. Perforations can be formed between the packages to allow each package to be detached individually for use.

More generally, advantages of the present nail enamel package include the unit-of-use size, production efficiency resulting in a low-cost product, and the aesthetically appealing and attractive appearance of the product when decorated with appropriate graphics.

By way of further illustration of the package and method of the invention, reference may be made to the following specific examples, employing acrylonitrile methylacrylate as the lid barrier film and tray sheet material:

EXAMPLE 1

Several hundred packages were fabricated with laboratory equipment and tested under various conditions to verify the package integrity and its performance.

The laboratory apparatus included an aluminum mold, used to vacuum form the tray sheet; a two-ton hydraulic vacuum forming press with pressure, temperature, and timing controls; a heat sealing press with temperature and dwell time control for sealing the lid to the tray; and a steel rule die for cutting the package to its final shape.

After the trays were formed, the nail enamel was metered (1 cc quantities) into the reservoir 24 and a brush 30 placed into its cavity 25. The lidding material was positioned on top of the tray and sealed thereto. The sealing was achieved with careful control of the temperature, pressure and dwell time of the sealing press, with a pressure setting of 80 p.s.i., a sealing platen temperature of 285° F.±2.5°, and a dwell time of 1.40 sec. ±0.01 sec.

The base material was 10 mil-thick acrylonitrile methylacrylate sheet. The lidding material was a laminate constituted of lacquer, print, paper, adhesive, polyester, print, adhesive, polyester, adhesive, and acrylonitrile methylacrylate barrier film. The seal area 23 around the brush cavity 25 averaged ⅛" wide, and 3/16" wide around the reservoir 24.

The packages thus made showed a weight loss of less than 0.04% after 60 days at 110° F. and 90% relative humidity, a seal strength of 2.08 lb./in., and no failure or leakage under vacuum of 20 inches of water.

EXAMPLE 2

Production was set up on a horizontal blister machine with the following machine setting: sealing pressure 1,200 p.s.i.; upper sealing die temperature 275° F.±3°; and lower sealing die temperature 150° F.±3°. The upper platen of the die was equipped with a special pattern of serrations: 45° crosshatched 36 lines per inch at a depth of 0.002 inch. This design allows the seal to peel with relative ease. The machine ran for 30 minutes and the average test results were similar to the data obtained in testing the laboratory samples.

The production run was limited to 30 minutes because the instrumentation on the machine was not able to maintain the precise control specified. Therefore, for extended production, the instrumentation would be re-engineered to maintain the control parameter within the tolerances established.

EXAMPLE 3

The acrylonitrile methylacrylate barrier film was tested for its chemical resistance and performance in storing various compounds. The results are summarized in the following tables:

TABLE I

Chemical Resistance to Solvents
(Effect of Two-Week Immersion)

| | 73° F. | 140° F. |
|---|---|---|
| Normal hexane | NC* | NC* |
| Carbon tetrachloride | NC | NC |
| Kerosene | NC | NC |
| Toluene | NC | NC |
| Trichlorethylene | NC | H |
| Benzene | NC | H |
| Water | NC | H |
| Ethyl alcohol (100%) | NC | P,H |
| Methyl alcohol (100%) | W | P,W |
| Ethyl acetate | NC | P,W |
| Methyl ethyl ketone | P,W | P,W |
| Acetone | P,W | P,W** |
| Dimethyl formamide | D | — |
| Acetonitrile | D | — |

Liquid Product Weight Change Data
Storage Time of 26 Weeks
(6-ounce cylinders, 18 mil wall thickness, 33.8 square inch surface)

| | 73° F., 50% RH | 100° F., 50% RH |
|---|---|---|
| Oil based foods | +0.1 to +0.2% | +0.1 to +0.2% |
| Oil/water foods | −0.7 to 1.5 | −1.1 to −3.6 |
| Water based foods | −0.8 to 2.0 | −2.2 to −4.8 |
| Water/solids foods | −1.2 to −2.1 | −2.1 to −3.8 |
| Toiletries and cosmetics | 0 to −2.3 | 0 to −5.2 |

TABLE I-continued

| | | |
|---|---|---|
| Household chemicals | 0 to −2.1 | 0 to −6.4 |

*NC - no change; H - hazy; P - plasticized; W - whitened; D - dissolved.
**Immersion temperature 100° F.

It is to be understood that the invention is not limited to the features and embodiments hereinabove specifically set forth but may be carried out in other ways without departure from its spirit.

I claim:

1. A package containing a body of liquid material including a volatile solvent, comprising (a) a molded sheet plastic tray defining at least one cavity, for receiving a body of liquid material, and having a substantially planar rim completely surrounding said one cavity; and (b) a lid of sheet material extending entirely over said one cavity and secured to said rim to enclose a body of liquid material received in said one cavity;

wherein the improvement comprises:

(c) a body of liquid material including a volatile solvent, received in said one cavity;

(d) at least facing surface portions of said tray and said lid, including the tray surface portion facing the interior of said one cavity and extending over said rim, being constituted of a polymeric material resistant to attack by said solvent, said polymeric material being acrylonitrile methacrylate; and (e) the lid and tray being secured as aforesaid by direct bonding of said polymeric material of said lid surface portion to that of said tray surface portion around said rim for providing a bond that seals the contained liquid material within the cavity and is substantially uniformly releasable when subjected to manual peeling forces to enable removal of the lid from the tray.

2. A package as defined in claim 1, wherein the area of said bond in the surface of at least one of said lid and said tray is embossed with small serrations effective to facilitate release of the bond as aforesaid while still providing an effectively leakproof seal for the contained liquid material prior to such release.

3. A package as defined in claim 2, wherein said tray is formed with a second cavity for holding a disposable applicator for said liquid material, said second cavity being isolated from the first-mentioned cavity by said bond an being itself sealed by an extension of said bond.

4. A package as defined in claim 3, wherein said tray is a thermoformed sheet consisting essentially of acrylonitrile methylacrylate.

5. A package as defined in claim 3, wherein said tray is a thermoformed sheet comprising a polymeric substrate and a barrier layer of acrylonitrile methylacrylate laminated to the lid-facing surface of the polymeric substrate.

6. A package as defined in claim 3, wherein said lid is a sheet comprising a substrate and a barrier film of acrylonitrile methylacrylate laminated to the tray-facing surface of the substrate.

7. A package as defined in claim 6, wherein said substrate comprises successive laminated layers of paper, metal foil and polyester.

8. A package as defined in claim 6, wherein at least one surface of said substrate is imprinted with decorative and/or informative indicia.

9. A method of packaging a quantity of a liquid material including a volatile solvent, comprising (a) molding a plastic sheet having at least a surface portion of polymeric material resistant to said solvent to form a tray including at least one liquid-receiving cavity within a surrounding substantially planar rim, wherein the polymeric material surface portion lines the cavity and the rim, said polymeric material being acrylonitrile methacrylate;

(b) filling the cavity with a predetermined quantity of said liquid material;

(c) covering the cavity and surrounding rim with a lid of sheet material having at least a surface portion, facing the tray and engaging the rim, of said polymeric material; and (d) bonding the polymeric material of the tray rim to the polymeric material of the lid to provide a bond that seals the liquid within the cavity and is readily and substantially uniformly releasable by manual peeling forces.

10. A method according to claim 9, wherein the bonding step includes embossing the bonded area of at least one of the tray and lid with a pattern of small serrations.

11. A method according to claim 9, wherein the bonding step comprises pressing the lid and tray together around the rim, with application of heat thereto, to provide a bond as aforesaid.

* * * * *